United States Patent [19]

Marten

[11] Patent Number: 4,538,498

[45] Date of Patent: Sep. 3, 1985

[54] IMPROVEMENTS IN AND RELATING TO AN ACOUSTIC GUITAR BRIDGE

[76] Inventor: Timothy J. Marten, 73 Crayford Rd., London N7, England

[21] Appl. No.: 544,832

[22] Filed: Oct. 24, 1983

[30] Foreign Application Priority Data

Oct. 28, 1982 [GB] United Kingdom ..... 8230782
Apr. 21, 1983 [GB] United Kingdom ..... 8310833

[51] Int. Cl.[3] ..... G10D 3/04
[52] U.S. Cl. ..... 84/298; 84/1.15
[58] Field of Search ..... 84/267, 307-309, 84/298, 299, 1.15, 1.16

[56] References Cited

U.S. PATENT DOCUMENTS 3,453,920 7/1969 Scherer ..... 84/307 X
4,160,401 7/1979 Tomioka ..... 84/307 X
4,253,371 3/1981 Guice ..... 84/307 X

FOREIGN PATENT DOCUMENTS 2105898 3/1983 United Kingdom ..... 84/307

*Primary Examiner*—Benjamin R. Fuller
*Attorney, Agent, or Firm*—Kane, Dalsimer, Kane, Sullivan and Kurucz

[57] ABSTRACT

This invention relates to an acoustic guitar bridge comprising a body shell (1) for attachment to the body of a guitar, an adjustable saddle member (12) for supporting the strings of the guitar and an adjustable support member (4) for engaging and supporting the saddle member along its length, the support member being housed within the shell and the saddle member being arranged in a slot (3) in the shell, those members being mounted for movement, relative to the body shell, in respective directions lying transverse to each other and engaging each other through surfaces at least one of which is inclined to the direction of movement of the support member whereby movement of the support member varies the height of the saddle member relative to the body shell.

10 Claims, 7 Drawing Figures

IMPROVEMENTS IN AND RELATING TO AN ACOUSTIC GUITAR BRIDGE

BACKGROUND OF THE INVENTION

This invention relates to an acoustic guitar bridge and to an acoustic guitar including such a bridge.

Acoustic guitar bridges are known which use two adjustment screws passing through the ends of a saddle member for supporting the strings of a guitar and engaging in two female threaded bushes secured to the guitar body. This is an unsatisfactory arrangement because there is an uneven distribution of vibration to the guitar body; all the vibration from the saddle member being imparted directly to the bushes fixed to the guitar body. Better quality guitars do not use this arrangement but seat the saddle member into a wooden block attached to the guitar body. Setting the desired height of the saddle member above the body of the guitar is not, however, easy to accomplish and involves paring the saddle member to reduce that height or adding shims in the slot receiving the saddle member to increase the height. Some of the better quality guitars also include transducer elements which are arranged at the base of the slot which receives the saddle member. That is to say, the saddle member sits on the transducer element and, as a result, the more even distribution of vibration given by this type of acoustic guitar bridge is effectively lost.

The present invention seeks to provide an acoustic guitar bridge which overcomes these disadvantages.

SUMMARY OF THE PRESENT INVENTION

The present invention provides an acoustic guitar bridge comprising a body shell for attachment to the body of the guitar, an adjustable saddle member for supporting the strings of the guitar and an adjustable support member for engaging and supporting the saddle member along its length, the support member being housed within the shell and the saddle member being arranged in a slot in the shell, those members being mounted for movement, relative to the body shell, in respective directions lying transverse to each other and engaging each other through surfaces at least one of which is inclined to the direction of movement of the support member, whereby movement of the support member varies the height of the saddle member relative to the body shell.

In the guitar bridge according to the invention the desired height of the saddle member can be adjusted not only very accurately but also very simply. Further, that adjustment can be made without affecting the distribution of vibration to the guitar body which is achieved uniformly by virtue of the support member supporting the saddle member along its whole length.

Further, the acoustic guitar bridge according to the invention may incorporate a transducer element without affecting the distribution of vibration to the guitar body. Thus the transducer element may be incorporated in the support member itself.

Advantageously the transducer element is filamentary in form and preferably extends between the bass and the treble ends of the support member. A groove may be provided in the support member for receiving the transducer element.

Although the open side of the body shell may be attached directly to the body of the guitar it is preferred if that open side is covered by a base plate which is attached to the body shell, the support member being movable across the plate and supported by it. Use of the base plate still further improves distribution of vibration to the guitar body.

Advantageously the support member has a portion which is triangular in section, one face of that portion constituting the inclined surface. The said portion of the support member is therefore of wedge like form which provides a very simple mechanism for raising and lowering the saddle member.

The saddle member is also, with advantage, provided with an inclined surface which engages the said one face of the support member. In that way there is optimum contact between the saddle member and the support member which leads to improved distribution of vibration.

Movement of the support member may be effected by at least one adjustment screw passing through the wall of the body shell. Advantageously two adjustment screws are provided, one at each of the bass and treble ends of the support member.

The present invention also provides an acoustic guitar incorporating a bridge according to the invention.

BRIEF SUMMARY OF THE DRAWINGS

An acoustic guitar bridge constructed in accordance with the present invention will now be described, by way of example only, with reference to the accompanying drawings in which.

DETAILED DESCRIPTION OF THE PREFERRED EMBODIMENT

Referring to the accompanying drawings, the acoustic guitar bridge comprises a body shell 1 made for example of wood, which is provided with a routed cavity 2 and the upper wall of which is provided with a slot 3.

Figure 2A:
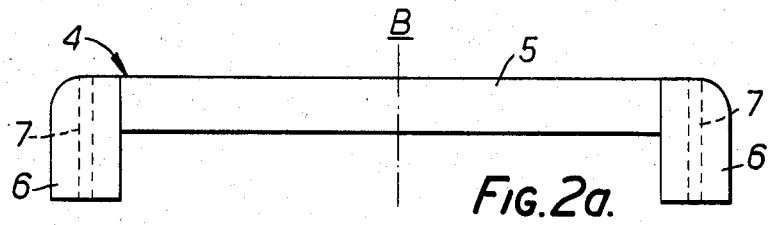
FIG. 2*a* is a top view of the support member of the bridge illustrated in FIG. 1.
Figure 2B:
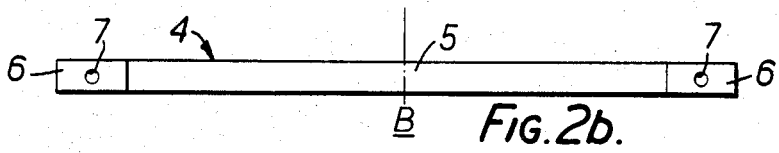
FIG. 2*b* is a rear elevation of the support member shown in FIG. 2*a*.
Figure 2C:
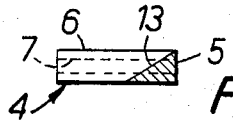
FIG. 2*c* is a section of the support member taken along the line B—B in FIGS. 2*a* and 2*b*.
Figure 4:
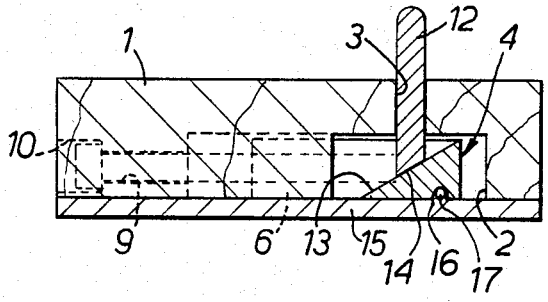
FIG. 4 is a cross-section of the bridge taken on the line A—A in FIG. 1 and showing the sound plate in position.

Mounted in the cavity 2 is a support member 4 which has an elongate central portion 5 which is triangular in cross-section (see FIG. 2*c* and FIG. 4). At each end of the portion 5 the support member 4 is provided with two lugs 6. Each lug 6 is provided with an internally threaded bore 7 each of which receives a respective one of two adjusting screws 8. Those screws pass through bores 9 in the wall of the body shell 1, the outer ends of those bores having widened portions or recesses 10 for receiving the heads 11 of the screws.

A saddle member 12 passes through the slot 3 and engages an inclined surface 13 provided by the central portion 5 of the support member 4. To provide optimum contact between the lower end of the saddle member 12 and the surface 13 that lower end has a chamfered surface 14.

The cavity 2 in the body shell 1 is closed (See FIG. 4) by a sound plate 15 which is secured, for example by adhesive, to the body shell.

Figure 1:
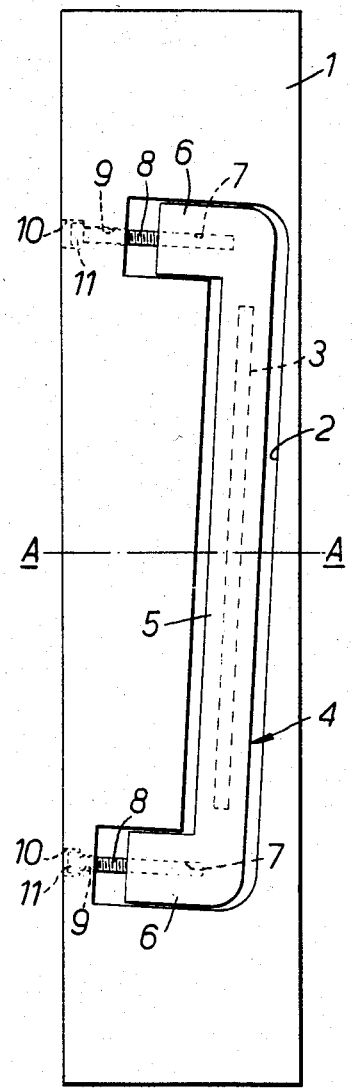
FIG. 1 is a bottom view of the bridge with the sound plate removed.
Figure 3A:
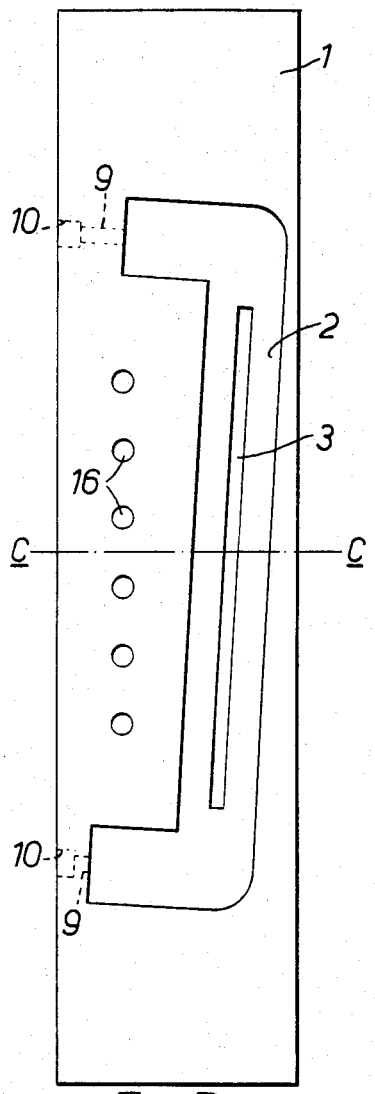
FIG. 3*a* is a bottom view of the body shell of the bridge shown in FIG. 1.
Figure 3B:
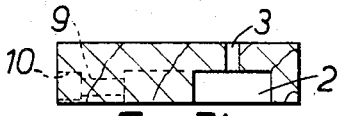
FIG. 3*b* is a section through the body shell taken on the line C—C in FIG. 3*a*.

In use, the sound plate 15 is secured for example, by adhesive, to the body of the guitar and the strings of the guitar are passed over the saddle member 12. The body shell may be provided with holes 16 for receiving bridge pins (not shown) to which the ends of the strings are secured. It will be evident from FIGS. 1 and 3 that the slot 3 is inclined to the direction in which the strings extend so that each string of the guitar will, as required, be of a different effective length when mounted over the saddle member 12.

By adjusting one or both of the screws 8 the support member 4 will slide across the sound plate 15 and as it does so the vertical height of the saddle member 12 relative to the upper wall of the body shell 1 will vary. Vertical movement, upwards or downwards, of the saddle member 12 is effected by the engagement between the chamfered end 14 of that member and the inclined surface 13 is provided on the portion 5 of the support member 4.

It will be appreciated that the acoustic guitar bridge described above has been illustrated diagrammatically and the dimensions of the various components of the bridge can be varied as desired. The height of the central portion 5 of the support member dictates the amount of vertical adjustment of the saddle member and that height may be varied within any desired range. Further, the amount of movement of the support member 4 across the sound plate 15 to effect a given vertical displacement of the saddle member 12 will depend on the width of the central portion 5 of the support member and generally that width is dictated by the size of the of the body shell 1 and its cavity 2.

It should be noted that the width of the routed cavity 2 must be enough to allow sufficient forward movement to bring the saddle member 12 to its minimum height at the rear or thin end of the central portion 5 of the support member 4 and enough backward movement to bring the saddle member to the maximum height at the front or thick end of the central portion 5. Further the saddle slot 3 should be cut in such a position as to allow the two extremes of adjustment within the confines of the body shell 1 and its cavity 2.

The thick end of the central portion 5 of the support member 4 may be provided with an elongate groove 16 for receiving a transducer element 17 which is filamentary in form, the groove extending along the length of the portion 5. The transducer provides electric signals in response to vibration and may, for example, comprise a piezo-electric crystal.

I claim:

1. An acoustic guitar bridge comprising a body shell for attachment to the body of a guitar, an adjustable saddle member for supporting the strings of the guitar and an adjustable support member for engaging and supporting the saddle member along its length, the support member being housed within the shell and the saddle member being arranged in a slot in the shell, those members being mounted for movement, relative to the body shell, in respective directions lying transverse to each other and engaging each other through surfaces at least one of which is inclined to the direction of movement of the support member whereby movement of the support member varies the height of the saddle member relative to the body shell.

2. An acoustic guitar bridge as claimed in claim 1, in which the body shell has an open side, and the bridge further comprises a plate, the plate closing the open side of the body shell and being attached to the body shell, and the support member being movable across the plate and supported by it.

3. An acoustic guitar bridge as claimed in claim 1, in which the support member has a portion which is triangular in section, one face of that portion constituting the inclined surface.

4. An acoustic guitar bridge as claimed in claim 3, in which the saddle member also has an inclined surface engaging the said one face.

5. An acoustic guitar bridge as claimed in claim 1, in which movement of the support member is effected by at least one adjustment screw passing through the wall of the body shell.

6. An acoustic guitar bridge as claimed in claim 5, in which two adjustment screws are provided, one at each of the bass and treble ends of the support member.

7. An acoustic guitar bridge as claimed in claim 1, in which a transducer element is incorporated in the bridge.

8. An acoustic guitar bridge as claimed in claim 7, in which the transducer element is incorporated in the support member.

9. An acoustic guitar bridge as claimed in claim 7, in which the transducer element is filamentary in form.

10. An acoustic guitar bridge as claimed in claim 7, in which the transducer element is incorporated in the support member and is filamentary in form, the transducer element extending between the bass and treble ends of the support member.

* * * * *